US008708336B2

(12) United States Patent
Taguchi

(10) Patent No.: US 8,708,336 B2
(45) Date of Patent: Apr. 29, 2014

(54) RECORDING MEDIUM DISCHARGE DEVICE AND IMAGE FORMING APPARATUS

(71) Applicant: KYOCERA Document Solutions Inc., Osaka (JP)

(72) Inventor: Tetsuya Taguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/753,931

(22) Filed: Jan. 30, 2013

(65) Prior Publication Data

US 2013/0193637 A1 Aug. 1, 2013

(30) Foreign Application Priority Data

Jan. 31, 2012 (JP) ..... 2012-018876

(51) Int. Cl.
*B65H 31/04* (2006.01)

(52) U.S. Cl.
USPC ..... 271/214; 271/213; 271/207

(58) Field of Classification Search
USPC ..... 271/213, 207, 214, 215, 217
See application file for complete search history.

(56) References Cited

U.S. PATENT DOCUMENTS

| | | | | |
|---|---|---|---|---|
| 7,341,249 | B2 * | 3/2008 | Ohtsuka et al. | 271/298 |
| 2008/0029950 | A1 * | 2/2008 | Wada et al. | 271/147 |

FOREIGN PATENT DOCUMENTS

| | | | |
|---|---|---|---|
| JP | H11-130321 | A | 5/1999 |
| JP | 2004-284790 | A | 10/2004 |
| JP | 2006-096496 | | 4/2006 |
| JP | 2006-273581 | A | 10/2006 |

OTHER PUBLICATIONS

Japanese Office Action for Japanese Application No. 2012-018876 mailed Jun. 4, 2013.

* cited by examiner

*Primary Examiner* — Michael McCullough
*Assistant Examiner* — Howard Sanders
(74) *Attorney, Agent, or Firm* — Pearl Cohen Zedek Latzer Baratz LLP

(57) ABSTRACT

A drive controlling unit causes an ascending and descending unit to lower a recording medium discharge tray, and then causes raising of the recording medium discharge tray until detection of the upper surface of the recording medium by an upper surface detection sensor. A determining unit determines whether a raising time of the recording medium discharge tray measured by a measuring unit is a predetermined abnormal time. When the raising time is determined by the determining unit not to be the abnormal time, the drive controlling unit causes the recording medium discharge unit to execute the subsequent recording medium discharge into the recording medium discharge tray. When the raising time is determined by the determining unit to be the abnormal time, the drive controlling unit causes the recording medium discharge unit to stop the subsequent recording medium discharge into the recording medium discharge tray.

3 Claims, 4 Drawing Sheets

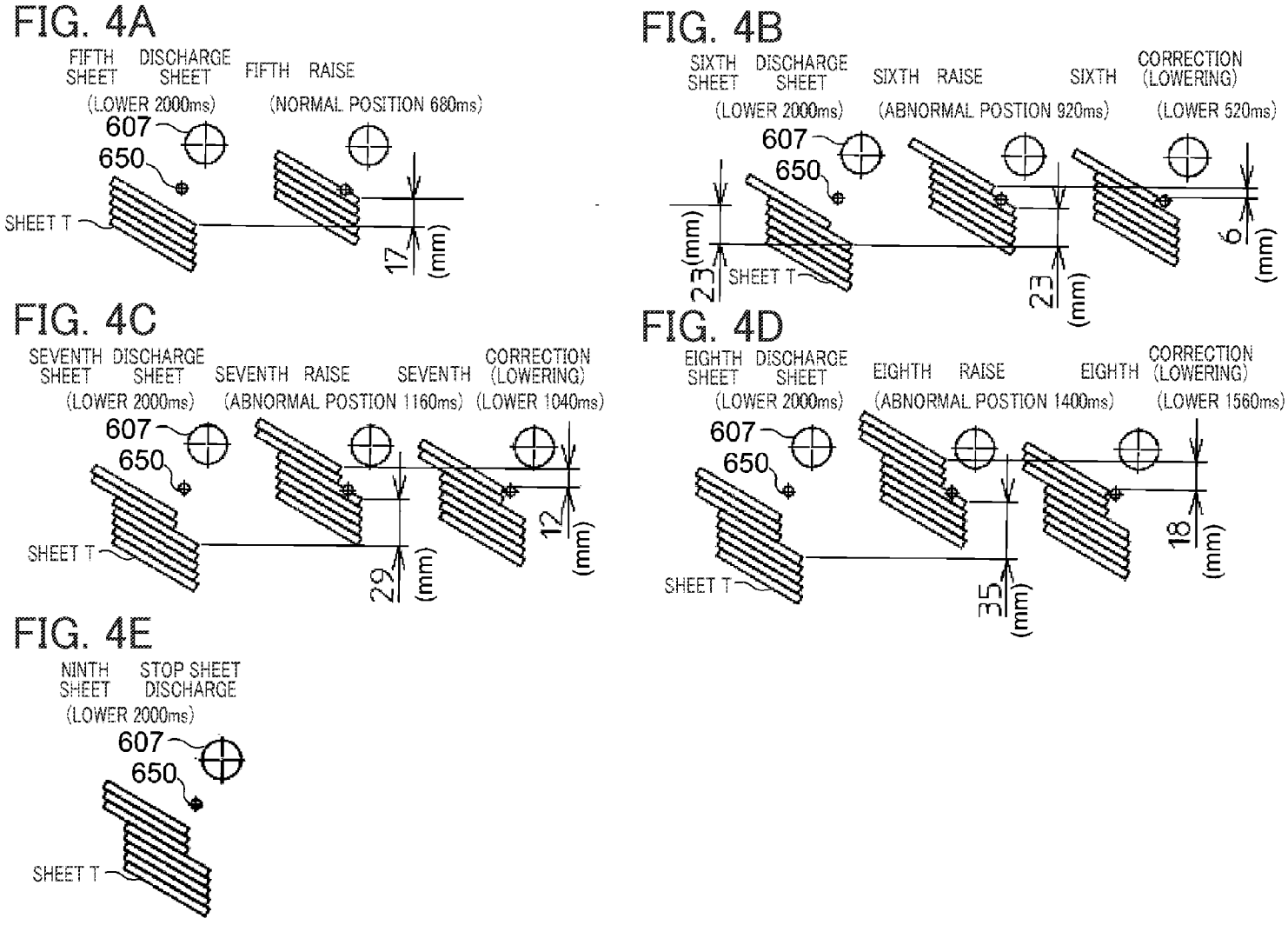
FIG. 4A
FIFTH SHEET DISCHARGE SHEET
(LOWER 2000ms)
FIFTH RAISE
(NORMAL POSITION 680ms)
607
650
17 (mm)
SHEET T
FIG. 4B
SIXTH SHEET DISCHARGE SHEET
(LOWER 2000ms)
SIXTH RAISE
(ABNORMAL POSITION 920ms)
SIXTH CORRECTION (LOWERING)
(LOWER 520ms)
607
650
23 (mm)
23 (mm)
6 (mm)
SHEET T
FIG. 4C
SEVENTH SHEET DISCHARGE SHEET
(LOWER 2000ms)
SEVENTH RAISE
(ABNORMAL POSITION 1160ms)
SEVENTH CORRECTION (LOWERING)
(LOWER 1040ms)
607
650
29 (mm)
12 (mm)
SHEET T
FIG. 4D
EIGHTH SHEET DISCHARGE SHEET
(LOWER 2000ms)
EIGHTH RAISE
(ABNORMAL POSITION 1400ms)
EIGHTH CORRECTION (LOWERING)
(LOWER 1560ms)
607
650
35 (mm)
18 (mm)
SHEET T
FIG. 4E
NINTH SHEET STOP SHEET DISCHARGE
(LOWER 2000ms)
607
650
SHEET T

RECORDING MEDIUM DISCHARGE DEVICE AND IMAGE FORMING APPARATUS

INCORPORATION BY REFERENCE

This application is based upon and claims the benefit of priority from the corresponding Japanese Patent Application No. 2012-018876, filed in the Japan Patent Office on Jan. 31, 2012, the entire contents of which are incorporated herein by reference.

BACKGROUND

This disclosure relates to a recording medium discharge device and an image forming apparatus, and in particular, relates to control of an ascending and descending operation for a stacking unit during discharge of a recording medium.

Conventionally, an image forming apparatus includes a recording medium discharge device that discharges a recording medium after completion of image formation or after post-processing such as a punching process and the like, and in which a recording medium discharge tray receives and stacks the discharged recording medium. In this recording medium discharge device, when a disturbance occurs in the stacking state of the recording medium during recording medium stacking into the recording medium discharge tray, the recording medium is not stacked properly into the recording medium discharge tray. As a result, when it is detected that the upper surface of a recording medium bundle that is stacked in the recording medium discharge tray is not in the correct vertical orientation relative to the recording medium discharge port by using a detecting sensor, a technique is adopted by which the upper surface of the recording medium bundle on the recording medium discharge tray is corrected to a correct vertical orientation by raising after the recording medium discharge tray is lowered by a fixed amount.

Conventionally, a technique is disclosed in which, for example, even when the recording medium discharge tray is lowered by a fixed amount, if the upper surface of the recording medium that is on the recording medium discharge tray continues to be detected in the same predetermined position as prior to the lowering operation, the recording medium discharge tray is further lowered by the predetermined amount. The lowering operation by a predetermined amount is executes for at least a regulated number of occasions, and when the upper surface of the recording medium is no longer detected at the predetermined position, the recording medium discharge tray is raised again until the upper surface is detected, and the fall height of the recording medium into the recording medium discharge tray is maintained at a fixed level (Prior Art 1).

A further conventional technique is disclosed in which the recording medium is discharged and the recording medium discharge tray is lowered to the predetermined position. Even after the lowering operation, in the event that the upper surface of the recording medium bundle in the recording medium discharge tray continues to be detected at the predetermined position, the recording medium discharge tray is again lowered, and at the point in time when the upper surface of the recording medium is no longer detected at the predetermined position, the recording medium discharge tray is switched to a raising operation (Prior Art 2).

A further conventional technique is disclosed in which the recording medium on the recording medium discharge tray can be correctly detected, even when a gap is produced between the recording media stacked on the recording medium discharge tray, by forming a projection that is high in comparison to the other positions on the recording medium stacking surface. The projection is formed in a position that shields the light axis connecting the light emitting portion and the light receiving portion of a light sensor that detects the presence or absence of the recording medium in a region including the recording medium stacking surface of the discharge tray (Prior Art 3).

The configuration in Prior Art 1 and 2 above enables falling of the recording medium rear end into the recording medium discharge tray and correctly stacking the recording medium in the recording medium discharge tray by repeated performance of a lowering operation of the recording medium discharge tray as described above upon occurrence of a state in which the rear end of the recording medium that is discharged from the recording medium discharge port into the recording medium discharge tray cannot fall from the recording medium discharge port into the recording medium discharge tray. However, a solution is not provided in relation to a fault such as a paper jam in the periphery of the recording medium discharge port resulting, for example, from a level difference caused when, in the recording media that have fallen and been stacked into the recording medium discharge tray, the upper portion of the recording medium is stacked in an orientation that deviates from the other recording media and the upper surface of the recording media stacked in the stacking portion is not flat.

The configuration in Prior Art 3 above cannot accurately detect the recording medium position when a gap between the recording media is produced at a position separated from the light axis between the light emitting portion and the light receiving portion provided with a sensor for detecting the presence or absence of the recording medium, and therefore the technique disclosed in Prior Art 3 also cannot provide a solution to a malfunction such as a paper jam occurring in the periphery of the recording medium discharge port due to a difference in level in the height of the upper surface of the stacked recording media as described above.

SUMMARY

A recording medium discharge device according to a first aspect of the present disclosure includes a recording medium discharge unit, a stacking unit, an ascending and descending unit, an upper surface detecting unit, a discharge detecting unit, a drive controlling unit, a measuring unit and a determining unit. The recording medium discharge unit is configured to discharge a recording medium from a recording medium discharge port. The stacking unit is configured to stack the recording medium that is discharged from the recording medium discharge port by the recording medium discharge unit. The ascending and descending unit is configured to ascend and descend the stacking unit in a vertical direction relative to the recording medium discharge port. The upper surface detecting unit is configured to detect that the upper surface portion of the recording medium that is stacked in the stacking unit ascended and descended by the ascending and descending unit is positioned at a predetermined recording medium receiving position. The discharge detecting unit is configured to detect that the recording medium is discharged from the recording medium discharge port to the stacking unit. The drive controlling unit is configured to cause the ascending and descending unit to lower the stacking unit by a predetermined fixed amount when discharge of the recording medium to the stacking unit is detected by using the discharge detecting unit, and to cause the ascending and descending unit to raise the stacking unit from the lowered position to which the stacking unit is lowered by the fixed amount to a position at which the upper surface of the recording medium stacked in the stacking unit is detected by using the upper surface detecting unit. The measuring unit is configured to measure the raising time that is the time from the commencement to the completion of the raising operation of the stacking unit by the ascending and descending unit controlled by the drive controlling unit. The determining unit is configured to determine whether or not the raising time measured by the measuring unit is a predetermined abnormal time. When the raising time is determined by the determining unit not to be the abnormal time, the drive controlling unit causes the recording medium discharge unit to execute a subsequent recording medium discharge to the stacking unit. When the raising time is determined by the determining unit to be the abnormal time, the drive controlling unit causes the recording medium discharge unit to stop a subsequent recording medium discharge to the stacking unit.

BRIEF DESCRIPTION OF DRAWINGS

FIG. 4A to FIG. 4E illustrate respective comparisons of a position of the upper surface of the recording medium in the recording medium discharge tray at the lowered position during elevation control, the position of the upper surface of the recording medium in the recording medium discharge tray on completion of a raising operation from the lowered position, and a position of the upper surface of the recording medium in the recording medium discharge tray on completion of a lowering operation due to a correction.

DETAILED DESCRIPTION

A recording medium discharge device and an image forming apparatus according to the embodiment of the present disclosure will be described below making reference to the figures.

Figure 1:
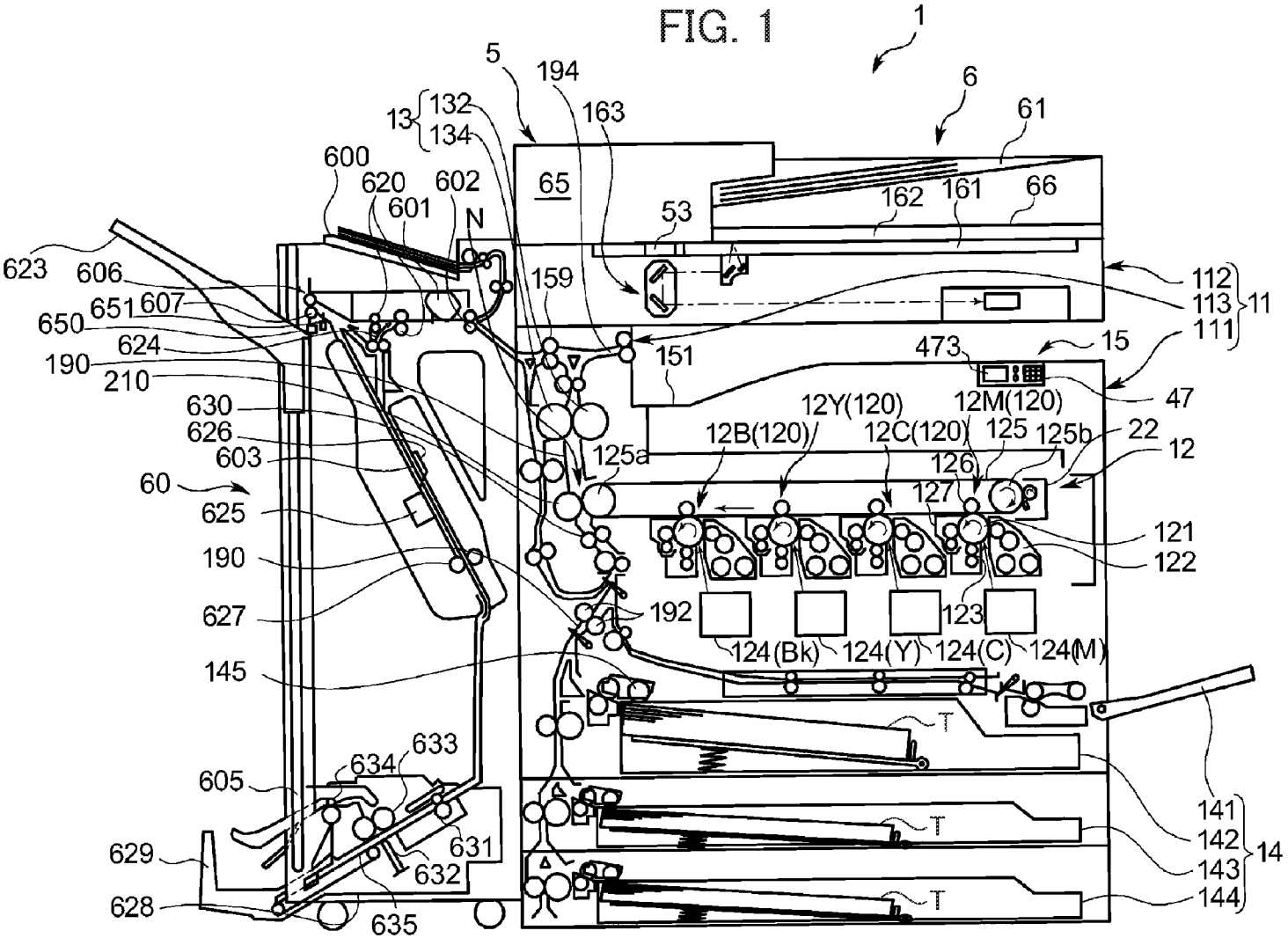
FIG. 1 illustrates the structure of a recording medium discharge device and an image forming apparatus according to an embodiment of the present disclosure.

FIG. 1 illustrates the structure of the recording medium discharge device and the image forming apparatus according to the embodiment of the present disclosure. The image forming apparatus 1 is a multi-functional peripheral that combines a plurality of functions such as a copying function, a printer function, a scanner function, a facsimile function, and the like. The image forming apparatus 1 includes an apparatus main body 11, and the apparatus main body 11 includes an image forming portion 12, a fixing unit 13, a paper feed unit 14, a recording medium discharge unit 15, a document conveying unit 6, and a document scanning unit 5. The image forming apparatus 1 further includes a recording medium discharge device (post-processing device) 60 according to the embodiment of the present disclosure.

The apparatus main body 11 includes a lower main body 111, an upper main body 112 disposed above the lower main body 111, and a connecting portion 113 disposed between the lower main body 111 and the upper main body 112. The upper surface of the lower main body 111 includes a recording medium stacking unit 15 of main body 11 side that receives a sheet-shaped recording medium T (below, simply referred to as a "sheet T") that is discharged from the connecting portion 113. The connecting portion 113 interconnects the lower main body 111 and the upper main body 112. The upper main body 112 is supported on the upper end of the connecting portion 113. The document scanning unit 5 and the document conveying unit 6 are provided on the upper main body 112.

The document scanning unit 5 includes a contact glass 161 accommodated on an upper surface of the upper main body 112, a document pressing cover 162 that can freely open and close, and a scanning mechanism 163. The document pressing cover 162 presses a document that is placed on the contact glass 161. The scanning mechanism 163 scans an image of a document placed on the contact glass 161. The scanning mechanism 163 optically scans an image of the document using a charge coupled device (CCD) and creates image data.

The document conveying unit 6 includes a document placing stage 61, a document discharge tray 66 to which a document that has been image-scanned is discharged, and a document conveying mechanism 65. The document conveying mechanism 65 includes a paper feed roller, a conveying roller and a recording medium inversion unit, none of which are illustrated in the drawings. The document conveying mechanism 65 feeds individual sheets of documents placed on the document placing stage 61 using the driving of the conveying roller and the paper feed roller. Then, the document conveying mechanism 65 conveys the fed document to a position facing a document scanning slit 53. Scanning of the document is performed by the scanning mechanism 163 through the document scanning slit 53. Then, the document conveying mechanism 65 discharges the scanned document to the document discharge tray 66.

The document conveying unit 6 is provided to rotate freely relative to the upper main body 112 so that the front surface side thereof can displace upwardly. A user opens the upper surface of the contact glass 161 that acts as a document stage by displacing the front surface side of the document conveying unit 6 upwardly. In this state, a user places a document to be scanned, for example, a book and the like in an opened configuration, on the upper surface of the contact glass 161.

The image forming portion 12, the fixing unit 13 and the paper feed unit 14 are provided in an inner portion of the lower main body 111. The document scanning unit 5 is provided on the upper main body 112. The paper feed unit 14 includes a plurality of paper feed cassettes 142, 143, 144. All of the paper feed cassettes 142, 143, 144 can be inserted into and removed from the apparatus main body 11. The sheets T are accommodated respectively in the paper feed cassettes 142, 143, 144.

The image forming portion 12 performs an image forming operation for forming a toner image on the sheet T that is fed from the paper feed unit 14. The image forming portion 12 includes a magenta image forming portion 12M that uses magenta colored toner, a cyan image forming portion 12C that uses cyan colored toner, a yellow image forming portion 12Y that uses yellow colored toner, a black image forming portion 12B that uses black colored toner, an intermediate transfer belt 125, and a secondary transfer roller 210. The image forming units 12M, 12C, 12Y and 12B are disposed in sequence from an upstream side to a downstream side in the direction of travel of the intermediate transfer belt 125. When a distinction is not made in relation to the image forming units 12M, 12C, 12Y and 12B, those units are generally referred to as "image forming unit 120". The intermediate transfer belt 125 is wound around a plurality of rollers such as the drive roller 125*a* (a roller opposite to the second transfer roller), and therefore executes endless travel in a sub-scanning direction for image forming. The secondary transfer roller 210 abuts with the outer peripheral surface of the intermediate transfer belt 125 at the position at which the intermediate transfer belt 125 is wound around the drive roller 125*a*.

The respective image forming units 120 is integrally configured to include a photosensitive drum 121, a developing device 122 that supplies toner to the photosensitive drum 121, a toner cartridge (not illustrated) that contains toner, a charging device 123, an exposing device 124, a primary transfer roller 126, and a drum cleaning device 127.

The circumferential surface of the photosensitive drum 121 is configured to carry an electrostatic latent image and a toner image corresponding to the electrostatic latent image. The developing device 122 supplies toner to the photosensitive drum 121. The respective developing devices 122 are suitably supplied with toner from the toner cartridge.

The charging device 123 is provided immediately below the photosensitive drum 121. The charging device 123 charges the surface of the photosensitive drum 121 uniformly.

The exposing device 124 is provided below the photosensitive drum 121 in a position below the charging device 123. The exposing device 124 illuminates laser light corresponding to a color onto the circumferential surface of the photosensitive drum 121 based on image data acquired by the document scanning unit 5 or image data input from a computer and the like. The photosensitive drum 2 is charged in advance and therefore an electrostatic latent image is formed on the circumferential surface of the photosensitive drum 121. The exposing device 124 is a so-called laser illumination device, and includes a laser light source, a polygon mirror, and optical components such as a lens, a mirror, and the like. The laser light source outputs a laser beam. The polygon mirror reflects the laser beam towards the circumferential surface of the photosensitive drum 121. The optical components guide the laser light that is reflected by the polygon mirror to the photosensitive drum 121.

The developing device 122 supplies toner to the electrostatic latent image on the circumferential surface of the photosensitive drum 121 that is rotated in the direction of the arrow. The supplied toner becomes attached to the circumferential surface of the photosensitive drum 121. In this manner, a toner image that corresponds to the image data is formed on the circumferential surface of the photosensitive drum 121.

The intermediate transfer belt 125 is disposed above all of the photosensitive drums 121. The intermediate transfer belt 125 is wound around the drive roller 125*a* disposed at the left side and a driven roller 125*b* disposed at the right side as illustrated in FIG. 1. The lower outer peripheral face of the intermediate transfer belt 125 abuts with the circumferential surfaces of all of the photosensitive drums 121. The driven roller 125*b* is disposed on the opposite side to the drive roller 125*a* in the endless path of the intermediate transfer belt 125, and is driven to rotate by the endless travel of the intermediate transfer belt 125. The image carrying surface onto which the toner image is transferred is provided on the outer peripheral surface of the intermediate transfer belt 125. The intermediate transfer belt 125 is driven by the drive roller 125*a* in a state in which the image carrying surface of the intermediate transfer belt 125 abuts with the circumferential surfaces of all of the photosensitive drum 121. The intermediate transfer belt 125 travels in an endless loop between the drive roller 125*a* and the driven roller 125*b* in synchronization with all of the photosensitive drums 121.

The primary transfer roller 126 is provided at a position that sandwiches the intermediate transfer belt 125 and faces the photosensitive drum 121. A transfer bias voltage is applied to the primary transfer roller 126 by a transfer bias application mechanism (not illustrated). The primary transfer roller 126 transfers the toner image formed on the circumferential surface of the photosensitive drum 121 onto the image carrying surface of the intermediate transfer belt 125.

The drive roller 125*a* causes the intermediate transfer belt 125 to travel in an endless loop by the rotating drive force imparted by a drive motor (not illustrated). The drive motor is driven under the control of the control unit 10.

The control unit 10 (refer to FIG. 2) controls driving of the primary transfer roller 126 and the image forming unit 120 for each color in the following manner to thereby execute intermediate transfer (primary transfer). That is to say, a magenta toner image formed by the magenta image forming unit 12M is firstly transferred to the surface of the intermediate transfer belt 125. Then, a cyan toner image formed by the cyan image forming unit 12C is transferred to the same position on the intermediate transfer belt 125. Then, a yellow toner image formed by the yellow image forming unit 12Y is transferred to the same position on the intermediate transfer belt 125. Lastly, a black toner image formed by the black image forming unit 12B is transferred to the same position on the intermediate transfer belt 125. The transfer of these toner images is performed so that the respective colors of the toner images are superimposed. In this manner, the color toner image is formed on the image carrying surface of the intermediate transfer belt 125 (intermediate transfer (primary transfer)).

The transfer bias voltage is applied to the secondary transfer roller 210 by a transfer bias application mechanism (not illustrated). The secondary transfer roller 210 transfers the color toner image formed on the image carrying surface of the intermediate transfer belt 125 onto the sheet T conveyed from the paper feed unit 14. The secondary transfer roller 210 abuts with the outer peripheral surface of the intermediate transfer belt 125 in the portion of the recording medium conveying path 190 at which the intermediate transfer belt 125 is wound around the drive roller 125*a*. A transfer nip N for secondary transfer of the toner image onto the sheet T is formed between the secondary transfer roller 210 and the drive roller 125*a* to sandwich the intermediate transfer belt 125. A sheet T that is conveyed on the recording medium conveying path 190 passes between the intermediate transfer belt 125 and the secondary transfer roller 210 at the nip N, and the toner image on the intermediate transfer belt 125 is subjected to secondary transfer onto the sheet T.

A pair of resisting rollers 630 is provided upstream of the nip N of the secondary transfer roller 210 and the drive roller 125*a* in the conveying direction of a sheet T using the conveying roller 192. The resisting roller pair 630 places the conveyance of the sheet T in a temporary stand-by state in order to synchronize the timing of the toner image transfer from the intermediate transfer belt 125 by the second transfer roller 210 with the timing of conveying the sheet T from the resisting roller pair 630.

The drum cleaning device 127 is provided on the left of the photosensitive drum 121. The drum cleaning device 127 removes residual toner by cleaning the circumferential surface of the photosensitive drum 121. The circumferential surface of the photosensitive drum 121 that is cleaned by the drum cleaning device 127 is reoriented to the charging device 123 to re-perform the charging process.

The recording medium conveying path 190 that extends along the vertical direction is provided on the left of the image forming portion 12 in FIG. 1. A pair of conveying rollers 192 is provided in a suitable position in the recording medium conveying path 190. The conveying roller pair 192 conveys a sheet T fed from the paper feed unit 14 toward the nip N and the fixing unit 13. The sheet T is conveyed by the conveying mechanism formed from the conveying roller pair 192 that is disposed at a suitable position.

The fixing unit 13 includes a heating roller 132 and a pressing roller 134. The heating roller 132 includes a conductive heat producing body as a heat source therein. The pressing roller 134 is disposed relative to the heating roller 132 to provide a fixing nip. As the sheet T passes through the fixing nip between the heating roller 132 and the pressing roller 134, the fixing unit 13 executes a fixing process by application of heat from the heating roller 132 to the toner image on the sheet T that is transferred by the image forming portion 12. The sheet T having a color image after completion of the fixing processing passes through a discharge conveying path 194 provided from the lower main body 111 across the connecting portion 113, provided above the fixing unit 13, and is discharged from the connecting portion 113 toward the discharge tray 151 provided on the top portion of the lower main body 111.

A cleaning unit 22 is provided opposite to the outer peripheral surface of the intermediate transfer belt 125 that is wound around the driven roller 125*b*.

The paper feed unit 14 includes a manual feed tray 141, and paper feed cassettes 142, 143, 144. The manual feed tray 141 is provided to open and close freely on the right side wall of the apparatus main body 11. The paper feed cassettes 142, 143, 144 are provided below the exposure device 124 in an inner portion of the lower main body 111 and can be inserted into and removed from the lower main body 111.

The manual feed tray 141 is provided below the right side surface of the lower main body 111. The manual feed tray 141 is a tray for supplying a sheet T towards the image forming portion 12 by using a manual operation. The paper feed cassettes 142, 143, 144 accommodate a bundle of sheets T stacking a plurality of sheets T. A pickup roller 145 is provided above the paper feed cassette 142. The pickup roller 145 feeds the uppermost sheet T in the sheet bundle T accommodated in the paper feed cassettes 142, 143, 144 toward the recording medium conveying path 190.

The recording medium stacking unit 15 is provided between the lower main body 111 and the upper main body 112. The recording medium stacking unit 15 includes the discharge tray 151 provided on an upper surface of the lower main body 111. The sheet T having a toner image formed by the image forming portion 12 is discharged to the discharge tray 151 after executing of a fixing process by the fixing unit 13.

The image forming apparatus 1 further includes a post-processing device 60 as the recording medium discharge device. The post-processing device 60 includes a document stage 600, a punch portion 601, a conveying roller pair 602, a recording medium receiving stage 603, a conveying roller pair 620, a discharge roller pair 607, a recording medium discharge tray 623 and a conveying branching guide 624.

The post-processing device 60 further includes a stapling device 625, a stopping member 626, a conveying roller pair 627, a book binding unit 628, and a discharge tray 629.

A document that is post-processed in the post-processing device 60 is placed on the document stage 600.

The punch portion 601 performs a punching process as an example of post-processing in relation to the sheet T that is conveyed from the discharge roller pair 159 of the apparatus main body 11 or from the document stage 600. The sheet T that is subjected to punch processing by the punch portion 601 includes both a sheet T after image formation and a document on the document stage 600.

The recording medium receiving stage 603 temporarily stocks a document or sheet T that is conveyed by the conveying roller pair 602, 620 as a sheet bundle T.

The discharge roller pair 607 is provided at a recording medium discharge port 606 from which a sheet T is discharged from the post-processing device 60. The discharge roller pair 607 discharges a sheet T that is conveyed from the conveying roller pair 602, 620 and a sheet T that is conveyed from the recording medium receiving stage 603 to the recording medium discharge tray 623.

The recording medium discharge tray (stacking portion) 623 moves in the vertical direction in response to an ascending and descending operation of the ascending and descending unit 605. The recording medium discharge tray 623 receives a sheet T that is discharged from the recording medium discharge port 606 by the discharge roller pair 607 at the receiving position for the sheet T in proximity to the recording medium discharge port 606. The sheets T that are discharged from the recording medium discharge port 606 are stacked on the recording medium discharge tray 623.

The upper surface detecting sensor (upper surface detecting unit) 650 detects whether or not the upper surface of the sheet T that is discharged from the recording medium discharge port 606 and placed on the recording medium discharge tray 623 is in a predetermined reference position. The installation position of the upper surface detecting sensor 650 is below the recording medium discharge port 606. As a result, even when the upper portion of the sheets T that are already stacked on the recording medium discharge tray 623 has reached the height of the installation position of the upper surface detecting sensor 650, the next sheet T that is discharged from the recording medium discharge port 606 does not interfere with the upper portion of the sheets T that are placed on the recording medium discharge tray 623. The distance from the recording medium discharge port 606 to the installation position of the upper surface detecting sensor 650 is preset by the manufacturer of the image forming apparatus 1 or the post-processing device 60. The upper surface detecting sensor 650 for example is configured as a mechanical switching mechanism that switches to the ON position when pressed upwardly from below by an external force. The upper surface detecting sensor 650 switches to the ON position when pressed upwardly by the upper portion of the recording medium discharge tray 623 or by the upper portion of sheets T that are stacked on the recording medium discharge tray 623 due to the raising operation of the recording medium discharge tray 623 by the ascending and descending unit 605. In this manner, a configuration in which the upper portion of the recording medium discharge tray 623 or the upper portion of the sheets T that are stacked on the recording medium discharge tray 623 is at the installation position of the upper surface detecting sensor 650 can be detected by the output from the upper surface detecting sensor 650. The upper surface detecting sensor 650 outputs an upper surface detection signal that indicates switching to the ON position to a drive controlling unit 611 (reference is made to FIG. 2).

The discharge detecting sensor (discharge detecting unit) 651 includes an upright projection that projects into a path, and is configured from a mechanical switching mechanism that switches to the OFF position and to the ON position in response to the switching of the projection between an upright state and a depressed state. The discharge detecting sensor 651 is provided at a predetermined position downstream or upstream of the discharge roller pair 607 in the conveying direction of the sheet T. When the projection is depressed by the front end of the sheet T that is conveyed in the recording medium conveying path by the conveying roller pair 602, 620, the discharge detecting sensor 651 is switched to the ON position. When rear end of the sheet T separates from the projection and the projection returns to an upright configuration, the discharge detecting sensor 651 switches to the OFF position. The discharge detecting sensor 651 outputs a switch-on signal (High signal) and a switch-off signal (Low signal) to the drive controlling unit 611 described below (reference is made to FIG. 2). The falling edge from a switch-on signal (High signal) to a switch-off signal (Low signal) forms a recording medium rear end detection signal that indicates passage of the rear end of the sheet T through the position of the discharge detecting sensor 651. The drive controlling unit 611 performs drive control of the ascending and descending unit 605 using the recording medium rear end detection signal. The discharge detecting sensor 651 is disposed in proximity to the discharge roller pair 607 that is arranged at the recording medium discharge port 606, and therefore, the recording medium rear end detection signal enables discrimination of a configuration in which the rear end of the sheet T passes through the recording medium discharge port 606 and the sheet T is discharged to the recording medium discharge tray 623.

The stapling device 625 executes a stapling process as post-processing on the sheet T that is conveyed to the recording medium receiving stage 603.

The stopping member 626 stops and retains the lower end of the sheet T that is conveyed to the recording medium receiving stage 603. The conveying roller pair 627 conveys the sheet T from the recording medium receiving stage 603 in a downward direction.

The book binding unit 628 executes book binding by folding to the center the sheets T that are conveyed from the conveying roller pair 627. The sheets T that are subjected to book binding by the book binding unit 628 are discharged to the discharge tray 629.

The recording medium receiving stage 603 includes a drive unit (not illustrated) that displaces the stopping member 626 in the conveying direction of the sheets T. The drive unit performs driving operations in response to a control signal from the drive controlling unit 611 (reference is made to FIG. 2). The sheets T held by the stopping member 626 resulting from the driving of the drive unit are conveyed to the discharge roller pair 607. Next, the sheet T is discharged from the recording medium discharge port 606 to the recording medium discharge tray 623 by the discharge roller pair 607.

The stapling device 625 can be displaced by a drive unit (not illustrated) that is driven by a control signal from the drive controlling unit 611. When a normal stapling process is performed on a sheet T conveyed to the recording medium receiving stage 603, the stapling device 625 is displaced to near the end of the sheet T and a stapling process is executed in proximity to the end of the sheet T. When executing book binding on the sheet T, the stapling device 625 moves to near the center of the sheet T and performs saddle stitching by executing a stapling process in proximity to the center of the sheet T.

The book binding unit 628 includes a saddle stitch receiving stage 625, a conveying roller pair 631, a pressing member 632, a center folding roller pair 633 and a discharge roller pair 634. The sheets T that are saddle stitched by the stapling device 625 are placed on the saddle stitch receiving stage 625. The conveying roller pair 631 conveys a sheet T that is conveyed from the conveying roller pair 627 to the saddle stitch receiving stage 625. The pressing member 632 and the center folding roller pair 633 are provided to sandwich the front and the rear surfaces near to the center of a sheet T that is placed on the saddle stitch receiving stage 625. The discharge roller pair 634 discharges the sheet T, that is folded in the center by the center folding roller pair 633, to the discharge tray 629.

The ascending and descending unit 605 includes two pulleys, a belt and a guide unit, none of which are illustrated in the drawings. The two pulleys are driven by a drive force that is imparted by a drive source (not illustrated). The belt is wound around the two pulleys, and rotated in response to the rotation of the pulleys. The side portion of the recording medium discharge tray 623 is mounted on the belt. The guide unit guides the vertical movement of the recording medium discharge tray 623 due to the rotation of the belt. The ascending and descending unit 605 executes a going up and down operation and moves the recording medium discharge tray 623 in the vertical direction in response to drive control of the drive source by the drive controlling unit 611.

A user can input operation instructions from an operation unit (described below) on the image forming apparatus 1. In the image forming apparatus 1, input of operation instructions by a user enables execution of settings for post-processing on the sheet T and of settings for book binding processing of the sheet T after fixing of an image.

Figure 2:
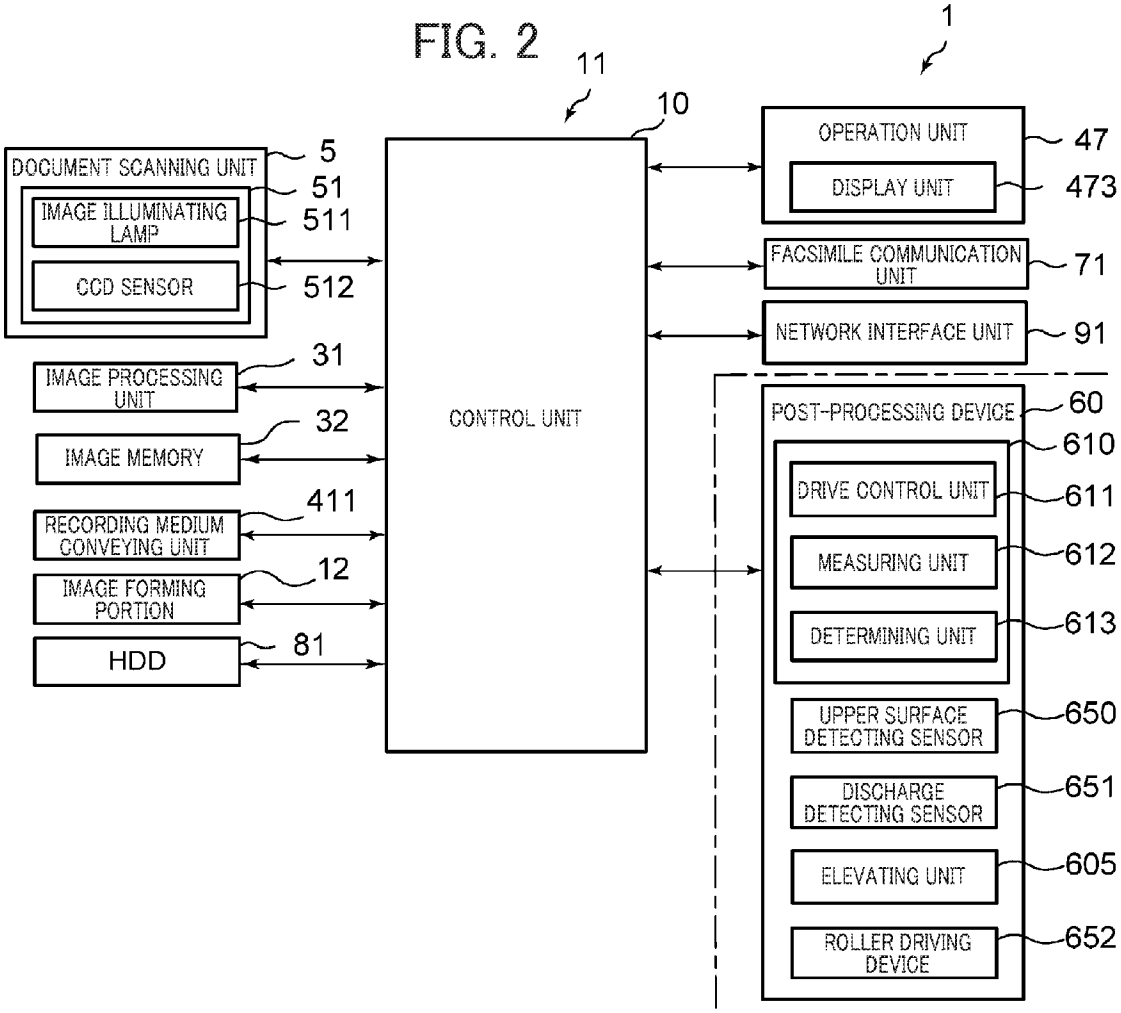
FIG. 2 is a functional block diagram illustrating the structure of the image forming apparatus.

Next, the electrical configuration of the image forming apparatus 1 that includes the post-processing device 60 will be described. FIG. 2 is a functional block diagram illustrating the structure of the image forming apparatus 1.

The image forming apparatus 1 includes the control unit 10. The control unit 10 includes a central processing unit (CPU), a RAM, a ROM and designated hardware circuits, and performs overall operational control of the image forming apparatus 1.

The control unit 10 is connected to the document scanning unit 5, an image processing unit 31, an image memory 32, a recording medium conveying unit 411, the image forming portion 12, the operation unit 47, a facsimile communication unit 71, a network interface unit 91, a hard disk drive (HDD) 81, and the like. The control unit 10 performs sending and receiving of data and signals between each constituent unit in addition to operational control of the constituent units that are connected with the control unit 10.

The control unit 10 controls the processing and driving of each constituent unit that is required for execution of operational control in relation to the respective functions such as the scanner function, the printer function, the copy function and the printer function in accordance with the execution instructions for the job input through the personal computer and the like that is connected to a network or from the operation unit 47 by a user.

The document scanning unit 5 includes a scanner portion 51 that is configured by a scanning mechanism 163. The scanner portion includes an image illumination lamp 511 and a charge coupled device (CCD) sensor 512. The document scanning unit 5 illuminates the document with the image illumination lamp 511 and scans an image from the document by receiving reflected light with the CCD sensor 512.

The image processing unit 31 makes image processing an image data for an image that is scanned with the document scanning unit 5 as needed. For example, the image processing unit 31 performs predetermined image processing in order to enhance the quality of the image after scanned with the document scanning unit 5 and formed with the image forming portion 12. The image data processed with the image processing portion 31 is either stored in the image memory 32 or output to the image forming portion 12 or the facsimile communication unit 71, and the like.

The image memory 32 stores the image data that is scanned with the document scanning unit 5 and the like.

The recording medium conveying unit 411 includes pick-up rollers 145 and conveying roller pairs 192 and the like as illustrated in FIG. 1. The recording medium conveying unit 411 conveys a sheet T that is stored in the manual tray 141, or the paper feed cassettes 142, 143,144 to the image forming portion 12, and then to the discharge roller pair 159 through the post-processing unit 60, and then to the recording medium discharge port 606.

The image forming portion 12 includes the image forming units 12M, 12C, 12Y and 12B, the intermediate transfer belt 125 that is suspended on a drive roller 125*a*, and the secondary transfer roller 210 as described above. The image data that is the subject of output by the image forming portion 12 is image data that is scanned by the document scanning unit 5, or image data that is sent from the client computer and the like in a local area through the network interface unit 91. In the description referring to FIG. 2, the image forming portion 12 includes the fixing portion 13. The image forming portion 12 in FIG. 2 is an example of an image forming portion within the scope of the patent claims.

The operation unit 47 includes a touch panel portion and an operation key portion as illustrated in FIG. 1 in addition to FIG. 2. The operation key portion and the touch panel portion receive instructions from a user in relation to various types of operations or processing that can be executed by the image forming apparatus 1. The touch panel unit is provided on a display unit 473 such as a liquid crystal display (LCD).

The facsimile communication unit 71 includes a coding/decoding unit, a modem, and a network control unit (NCU), none of which are illustrated in the drawings, and sends a facsimile by use of a public telephone circuit network. The facsimile communication unit 71 sends image data scanned by the document scanning unit 5 to a facsimile device and the like through a telephone circuit. The facsimile communication unit 71 receives image data sent from the facsimile device and the like.

The HDD 81 stores image data scanned by the document scanning unit 5. The image data stored in the HDD 81 is used in image formation by the image forming portion 12. The image data stored in the HDD 81 can also be sent to a client computer connected by a network to the image forming apparatus 1.

The network interface unit 91 is configured by a communication module such as a LAN board and the like. The network interface unit 91 sends and receives various data with a device in the local area (such as a personal computer and the like) through a LAN and the like that is connected to the unit 91.

The control unit 10 is connected to the post-processing device 60. The post-processing device 60 includes the control unit 610, the upper surface detecting sensor 650, the discharge detecting sensor 651, the ascending and descending unit 60, and a roller drive device 652. Although the post-processing device 60 has the above mechanism, the following description is related to the ascending and descending control for the recording medium discharge tray 623.

The control unit 610 is configured from the CPU, RAM, ROM and designated hardware circuits and the like. The control unit 610 includes the drive controlling unit 611, a measuring unit 612, and a determining unit 613.

The drive controlling unit 611 performs overall operational control of the post-processing device 60. The drive controlling unit 611 is operably linked by communicating with the control unit 11 on the apparatus main body 11 side to control the operation of various mechanisms in the post-processing device 60, or to control the operational mechanism of the display unit 473 and the like on the apparatus main body 11 side. The drive controlling unit 611 acquires the respective detection results from the upper surface detecting sensor 650 and the discharge detecting sensor 651, and controls the operation of the ascending and descending unit 605 in response to the acquired result.

The drive controlling unit 611 causes the ascending and descending unit 605 to lower the recording medium discharge tray 623 by a predetermined fixed amount when the discharge detecting sensor 651 detects that a sheet T is discharged from the recording medium discharge port 606 onto the recording medium discharge tray 623 by the discharge roller pair 607. The predetermined fixed amount is the lowering amount that is sufficient to draw the rear end of the sheet T from the recording medium discharge port 606, or is a lowering amount that is sufficient to change the orientation or move the sheet T to arrange the stacking configuration of the sheet T on the recording medium discharge tray 623 when the sheet T is discharged from the recording medium discharge port 606 onto the recording medium discharge tray 623. The predetermined fixed amount is predetermined by the manufacturer and the like of the image forming apparatus 1 or the post-processing device 360, and is set by the drive controlling unit 611.

The drive controlling unit 611 continues the above control to cause the ascending and descending unit 605 to lower the recording medium discharge tray 623, and from the lowered position at which lowering of the recording medium discharge tray 623 by a fixed amount is completed, control is performed to cause the ascending and descending unit 605 to raise the recording medium discharge tray 623 to the position at which the upper surface of the sheets T placed on the recording medium discharge tray 623 is detected by the upper surface detecting sensor 650.

The measuring unit 612 includes a timer and the like. The measuring unit 612 measures the raising time that is the time from the starting point to the stopping point of the raising operation by the control of the drive controlling unit 611, after lowering of the recording medium discharge tray 623 by the ascending and descending unit 605.

The determining unit 613 determines whether the raising time above measured by the measuring unit 612 is a predetermined abnormal time, and outputs the determination result to the drive controlling unit 611. The determining unit 613 estimates the raising time required for moving the recording medium discharge tray 623 that has been lowered by a fixed amount by the ascending and descending unit 605 from the lowered position to the position at which the upper surface of the sheets T stacked on the recording medium discharge tray 623 is detected by the upper surface detecting sensor 650, and sets the time as a normal raising time (reference time). The predetermined abnormal time is a time that exceeds the normal raising time by the predetermined time. The normal raising time and the abnormal time are predetermined in response to the performance and the like of the ascending and descending unit 605, such as the drive source described above, by a manufacturer and the like of the post-processing device 360 or the image forming apparatus 1, and are stored in the determining unit 613.

The roller drive device 652 is a drive force device such as a motor that imparts a rotational drive force onto the discharge roller pair 607. The roller drive device 652 is driven and controlled by the drive controlling unit 611. The roller drive device 652 also imparts a rotational drive force onto other rollers, for example, the conveyance roller pairs 602, 620, and the like. In the present embodiment, the roller drive device 652, the discharge roller pair 607 and the conveying roller pairs 602, 620 are an example of a recording medium discharge unit within the scope of the patent claims.

When the raising time has been determined by the determining unit 613 not to be the abnormal time, the drive controlling unit 611 drives the roller drive device 652, and causes the discharge roller pair 607 to perform the subsequent recording medium discharge operation into the recording medium discharge tray 623. When the raising time is determined by the determining unit 613 to be the abnormal time, the drive controlling unit 611 does not drive the roller drive device 652, and causes the discharge roller pair 607 to stop the subsequent discharge operation of the sheet T into the recording medium discharge tray 623. The stopping operation also includes a function of temporary stopping or standby.

Figure 3:
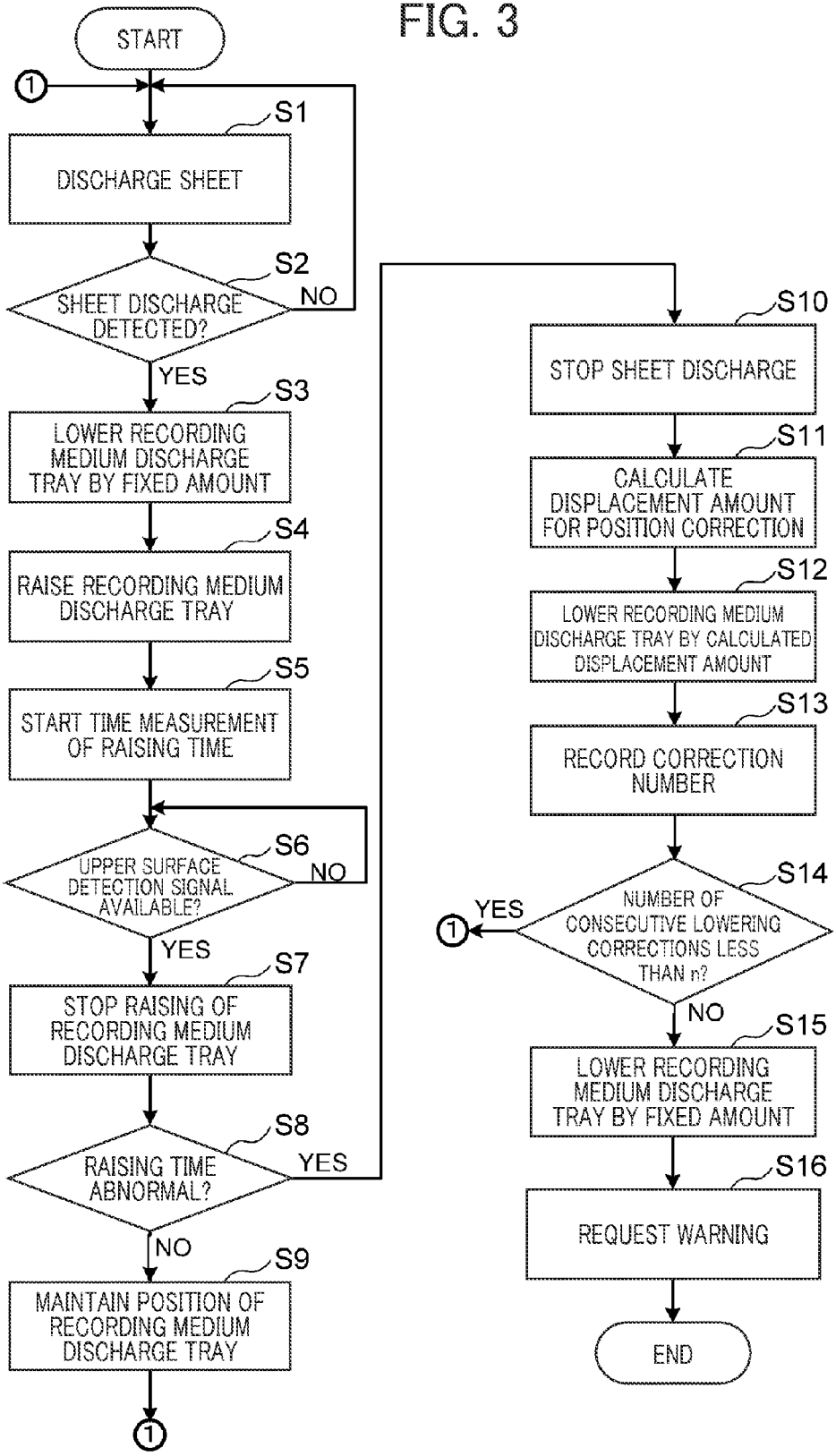
FIG. 3 is a flowchart illustrating elevation control of a recording medium discharge tray when a recording medium is discharged from a post-processing device.

Next, the ascending and descending control of the recording medium discharge tray 623 when the sheet T is discharged from the post-processing device 60 will be described. FIG. 3 is a flowchart illustrating elevation control of a recording medium discharge tray 623 when a sheet T is discharged from the post-processing device 60. FIG. 4A to FIG. 4E illustrate respective comparisons of a position of the upper surface of the sheet T in the recording medium discharge tray at the lowered position during elevation control, the position of the upper surface of the sheet T in the recording medium discharge tray on completion of a raising operation from the lowered position, and a position of the upper surface of the sheet T in the recording medium discharge tray on completion of a lowering operation due to a correction.

The standby position of the recording medium discharge tray 623 when no discharging a sheet T is below the recording medium discharge port 606. When for example, discharge of the sheet T is executed as required by the control unit 10 on the apparatus main body 11 side, the drive controlling unit 611 causes the ascending and descending unit 605 to performs an initializing operation by raising the recording medium discharge tray 623 to the position of the recording medium discharge tray 623 (when a sheet T is already placed in the recording medium discharge tray 623, to the upper surface of the placed sheet T) that is detected by the upper surface detecting sensor 650. The drive controlling unit 611 may be configured to not perform an initializing operation by causing the ascending and descending unit 605 to raise the recording medium discharge tray 623 in preparation to the position at which the recording medium discharge tray 623 is detected by the upper surface detecting sensor 650, when the previous discharge operation for the sheet T is completed.

The drive controlling unit 611 is configured to cause the ascending and descending unit 605 to move the recording medium discharge tray 623 to the position above, and then drive the roller drive device 652 to thereby rotate the conveying roller pairs 602, 620 and the discharge roller pair 607 and the like, and discharge the sheet T received from the apparatus main body 11, the recording medium receiving stage 603, or the document stage 600 from the recording medium discharge port 606 (S1).

When the drive controlling unit 611 acquires the detection signal as described above indicating completion of the discharge of sheet T from the discharge detection sensor 651 (YES in S2), the drive controlling unit 611 drives the ascending and descending unit 605 to lower the recording medium discharge tray 623 by the predetermined amount above described (S3). The drive controlling unit 611 causes the roller drive device 652 to continue the discharge operation in S1 above until the detection signal is acquired from the discharge detecting sensor 651 (NO in S2). That is to say, when the sheet T is discharged from the recording medium discharge port 606 to the recording medium discharge tray 623, the drive controlling unit 611 lowers the recording medium discharge tray 623 by a fixed amount. In this manner, separation of the rear end of the sheet T from the recording medium discharge port 606 can be ensured, and the orientation of the sheet T on the recording medium discharge tray 623 can be arranged.

For example, in the present embodiment, when the fixed amount is configured with reference to a lowering speed of the recording medium discharge tray 623 by the ascending and descending unit 605 of 11.5 mm/s, the drive time of the ascending and descending unit 605 is stored in the drive controlling unit 611 as 2000 ms. In this case, the fixed amount above represented as a lowering distance is a lowering distance of 23 mm.

The drive controlling unit 611 causes the ascending and descending unit 605 to lower the recording medium discharge tray 623 by a fixed amount, and then causes the ascending and descending unit 605 to raise the recording medium discharge tray 623 from the position after lowering (S4). At this time, the drive controlling unit 611 causes the measuring unit 612 to start measuring the elapsed time from the start time of the raising operation (S5).

After commencement of the raising operation, the upper surface of the sheets T stacked in the recording medium discharge tray 623 is detected by the upper surface detecting sensor 650, and when the drive controlling unit 611 receives the upper surface detection signal from the upper surface detecting sensor 650 (YES in S6), the drive controlling unit 611 causes the ascending and descending unit 605 to stop the raising operation of the recording medium discharge tray 623 (S7).

Then, the determining unit 613 acquires from the measuring unit 612 the time measured by the measuring unit 612 at the stop time for the raising operation, and determines whether or not the measured time is the abnormal time described above (S8). That is to say, the determining unit 613 determines whether the time required for the raising operation greater than the normal raising time described above by at least the fixed time.

For example, in the present embodiment, when the raising speed of the recording medium discharge tray 623 due to the ascending and descending unit 615 is 25 mm/s (the lowering speed in the same manner is 11.5 mm/s), the normal raising time is 680 ms, the fixed time is a time band of at least 170 ms to less than 2000 ms, and the abnormal time is a time band of at least 850 ms to less than 2850 ms. The reason for imposing an upper limit on the abnormal time is to retain the raising operation to the enabled range taking into account the configuration of the ascending and descending unit 605 and the recording medium discharge tray 623.

In this context, when the determining unit 613 determines that the measured time t1 measured by the measuring unit 612 at the stop point of the raising operation is not an abnormal time as described above (NO in S8), the drive controlling unit 611 does not cause the ascending and descending unit 615 to move the recording medium discharge tray 623, and the recording medium discharge tray 623 is maintained at the height position of the recording medium discharge tray 623 at which the upper surface of the sheet T has been detected by the upper surface detecting sensor 650 (S9). That is to say, the settings of the present embodiment are such that when the determining unit 613 determines that measured time t1<abnormal time lower limit (850 ms), the drive controlling unit 611 stops driving of the ascending and descending unit 605 at the position at which the upper surface of the sheet T detected by the upper surface detection sensor 650, and holds the recording medium discharge tray 623 at that position.

After the recording medium discharge tray 623 is moved to the height position above of the upper surface of the sheet T that is detected by the upper surface detecting sensor 650, the processing returns to S1, and the drive controlling unit 611 controls the driving of the roller drive apparatus 652 to execute a discharge operation on the next sheet T. That is to say, the drive controlling unit 611 continuously executes the discharge job in relation to the sheets T.

On the other hand, when the determining unit 613 determines that the measured time t1 that is measured by the measuring unit 612 at the stop time of the raising operation above is the abnormal time above (YES in S8), the drive controlling unit 611 stops the roller drive device 652, the conveying roller pairs 602, 620, and the discharge roller pair 607 (the discharge of the sheet T is stopped), and temporarily suspends the discharge job for the sheet T (S10). The drive controlling unit 611 calculates the displacement amount (displacement time) of lowering the recording medium discharge tray 623 to thereby causes the ascending and descending unit 605 to correct the height position of the recording medium discharge tray 623 (S11).

That is to say, the settings of the present embodiment are such that when the determining unit 613 determines that abnormal time lower limiting value 850≤measured time t1<abnormal time upper limit 2850 ms, the above displacement amount m is calculated based on the time difference between the measured time t1 and the normal raising time 680 ms. For example, in the same manner as above, since the raising speed of the recording medium discharge tray 623 by the ascending and descending unit 605 is 25 mm/s, and the lowering speed is 11.5 mm/s, the drive controlling unit 611 calculates the displacement amount m from the formula displacement amount m=((measured time t1−680)*(25/11.5) ms . . . Formula 1.

After calculation of the displacement amount, the drive controlling unit 611 causes the ascending and descending unit 605 to execute a correction operation to lower the recording medium discharge tray 623 by the calculated displacement amount (S12).

The correction operation will be described below making reference to FIG. 4. As illustrated in FIG. 4A, during execution of the discharge operation of the sheets T, it is assumed that a fifth sheet T has been discharged from the recording medium discharge port 606 into the recording medium discharge tray 623. In this case, as described above, the drive controlling unit 611 causes the ascending and descending unit 605 to lower the recording medium discharge tray 623 with reference to the fixed time 2000 ms. After this lowering operation, the relationship of measured time t1<abnormal time lower limit 850 is satisfied when the measured time t1 takes a value of 680 ms at the point when the drive controlling unit 611 causes the ascending and descending unit 605 to raise the recording medium discharge tray 623 to the position at which the upper surface of the sheet T is detected by the upper surface detecting sensor 650. Therefore, the drive controlling unit 611 does not perform the correction operation, and retains the recording medium discharge tray 623 to the position raised 680 ms from the lowered position, and prepare the discharge of the next sheet T.

Then when a sixth sheet T has been discharged from the recording medium discharge port 606 into the recording medium discharge tray 623, in the same manner as above, the drive controlling unit 611 causes the ascending and descending unit 605 to perform lowering and raising of the recording medium discharge tray 623. As illustrated in FIG. 4B, when the position of the sixth sheet T diverges from that of the lower sheet T, and the upper surface of the sheet T on the recording medium discharge tray 623 is configured by two levels, the height surface corresponding to the installation position of the upper surface detecting sensor 650 is lower than the height surface of other portions, and therefore the measured time t1 to the upper surface detecting sensor 650 in relation to a raising operation takes a value of 920 ms which is longer than the typical normal raising time of 680 ms. In this case, the abnormal time lower limiting value 850 ms≤measured time t1<abnormal time upper limiting value 2850 ms is satisfied, the drive controlling unit 611 calculates the displacement amount m≈520 ms from the formula displacement amount m=((measured time t1−680)*(25/11.5) ms . . . Formula (1), and causes the ascending and descending unit 605 to lower the recording medium discharge tray 623 by only that displacement amount.

When a seventh sheet T is discharged from the recording medium discharge port 606 into the recording medium discharge tray 623, as illustrated in FIG. 4C, the seventh sheet T is stacked onto the sixth sheet T, and diverges relative to the position of the fifth and previous sheets T, and therefore when the height surface of the seventh sheet T at the installation position of the upper surface detecting sensor 650 is higher than the height surface of other portions, the measured time t1 to the upper surface detecting sensor 650 in relation to a raising operation takes a value of 1160 ms which is longer than the normal raising time of 680 ms. In this case, since the relation of abnormal time lower limiting value 850 ms≤measured time t1<abnormal time upper limiting value 2850 ms is satisfied, the drive controlling unit 611 calculates the displacement amount m≈1040 ms from the Formula (1), and causes the ascending and descending unit 605 to lower the recording medium discharge tray 623 by only that displacement amount.

Thereafter, in the same manner, when an eighth sheet T is discharged from the recording medium discharge port 606 into the recording medium discharge tray 623, as illustrated in FIG. 4D, it is assumed that the eighth sheet T is stacked on the sixth and seventh sheets T, and diverges relative to the position of the fifth and previous sheets T, and that the measured time t1 is 1400 ms. In this case, the drive controlling unit 611 calculates the displacement amount m≈1560 ms, and causes the ascending and descending unit 605 to lower the recording medium discharge tray 623 by only that displacement amount.

The description will now return to FIG. 3. After S12, the drive controlling unit 611 stores the log for performing the correction operation described above in the internal memory and the like (S13).

After storing the log, the drive controlling unit 611 determines whether the correction operation has continued for a predetermined n occasions (in the present embodiment, n=3) including the current correction operation based on the previous history indicating the log and the previous log record (S14).

When the drive controlling unit 611 determines that the number of continuous executions of the correction operation is less than n occasions (YES in S14), the processing returns to S1, the drive controlling unit 611 controls the roller drive device 652 and executes a discharge operation on the next sheet T. That is to say, the drive controlling unit 611 restarts the discharge job of the sheet T. Although not illustrated in FIG. 3, the discharge operation for the sheet T that is recommenced after S14 and after S9 are completed by the completion of the discharge job for the sheet T.

Otherwise, when the drive controlling unit 611 determines that the number of continuous execution of the correction operation has reached n occasions (NO in S14), after the ascending and descending unit 605 is driven to lower the recording medium discharge tray 623 by the fixed amount above (S15), the drive controlling unit 611 sends an instruction requiring execution of display by the display unit (reporting unit) 473 to the control unit 10 of the image forming apparatus 1 (S16). Upon receipt of the request, the control unit 10 causes the display unit 473 to display a message to warn that the stacking of sheets T in the recording medium discharge tray 623 is full. The warning may be performed by providing a lighting device such as a lamp in the post-processing apparatus 60, and the drive controlling unit 611 controls the driving to illuminate the lighting device.

For example, when the execution of the correction operation as described with reference to FIGS. 4A to 4D continues for three occasions, as illustrated in FIG. 4D, after discharge of the eighth sheet T on the third continuous occasion, the drive controlling unit 611 causes the ascending and descending unit 605 to stop when the recording medium discharge tray 623 has been lowered for the fixed time of 2000 ms (FIG. 4E), and the display execution request above is sent to the control unit 10 of the apparatus main body 11.

As described above, according to the present embodiment, after once causing the ascending and descending unit 605 to lower the recording medium discharge tray 623, the drive controlling unit 611 raises the recording medium discharge tray 623 to the position at which the upper surface of the sheet is detected by the upper surface detecting sensor 650. The determining unit 613 determines whether or not the raising time required from commencement to completion of the raising operation of the recording medium discharge tray 623 measured by the measuring unit 612 is an abnormal time. As a result, based on the determining result that is determined based on the required time, the drive controlling unit 611 controls whether or not to cause the recording medium discharge unit such as the roller drive device 652, the conveying roller pairs 602, 620, and the discharge roller pair 607, and the like to discharge the next sheet T to the recording medium discharge tray 623.

For example, when the sheet T on an upper portion of the sheets T stacked in the recording medium discharge tray 623 diverges from other sheets T and causes a difference in level due to the difference in level in the upper surface of the sheets T stacked in the recording medium discharge tray 623, and results in a plurality of height surfaces in relation to the upper surface of the sheets T, the detection result will differ depending on the detection of a given height portion of the plurality of height surfaces based on a detection result of a mechanical or optical sensor. As a result, it is difficult to detect the situation in which the position of the upper surface of the sheet T has moved to the suitable receiving position for the sheet T, and it is difficult to discharge a sheet T by moving the recording medium discharge tray 623 to the suitable receiving position for the sheet T. In this regard, as described in the present embodiment, when discharge of the sheet T is controlled based on the determination result determined based on the required time, irrespective of whether the upper surface detecting sensor 650 can detect any of the height portions on the upper surface of the sheet T, accurate determination is enabled in relation to whether the recording medium discharge tray 623 after completion of the raising operation is at a suitable position, and accurate control is enabled in relation to whether or not to cause the recording medium discharge unit to perform discharge of the sheet T into the recording medium discharge tray 623.

As a result, in the present embodiment, accurate determination is enabled in relation to whether or not recording medium discharge tray 623 is positioned at the receiving position for the sheet T even when a state in which the rear end of the sheet T stacked in the recording medium discharge tray 623 remains caught in the recording medium discharge port 606, or a height on the upper surface of the sheets T does not fall within an estimation due to occurrence of a plurality of height surfaces on the upper surface of the stacked sheets T.

Therefore, according to the present embodiment, when a sheet T on the recording medium discharge tray 623 is in an abnormal stacking state, prevention of a malfunction such as a paper jam is enabled irrespective of that factor.

In the present embodiment, the drive controlling unit 611 causes the ascending and descending unit 605 to raise the recording medium discharge tray 623 by an amount corresponding to the time difference between the normal raising time (reference time) and the raising time measured by the measuring unit 612. As a result, according to the present embodiment, since adjustment of the vertical position of the recording medium discharge tray 623 for discharge of the next sheet T is performed by the correction based on a time element and is not performed by a correction based on a detection result of a mechanical or optical sensor, the discharge of the next sheet T can be performed by accurately displacing the recording medium discharge tray 623 to the suitable receiving position for the sheet T.

In the present embodiment, when a determination that the raising time is an abnormal time is performed continuously for a plurality of times by the determining unit 613, since there is a high possibility that suitable discharge of the sheet T cannot continue during a raising operation of the recording medium discharge tray 623 by the ascending and descending unit 605 under the control of the drive controlling unit 611, the display above (warning) by the display unit 473 is performed. In this manner, a user can be notified of the fact that the discharge operation for the sheet by the recording medium discharge unit and the ascending and descending operation of the recording medium discharge tray 623 have been stopped, and the sheet T will not be to the recording medium discharge tray 623.

This disclosure is not limited to the configuration of the above embodiment, and various modifications are possible. For example, in the above embodiment, when the determining unit 613 determines that the time t1 measured by the measuring unit 612 at the stopping point of the raising operation is an abnormal time, the drive controlling unit 611 performs a calculation of the displacement amount for the correction operation in addition to temporary suspension of the discharge job for the sheet T. However, an embodiment of this disclosure is realized also when calculation of the displacement amount and a correction operation are not performed, and the discharge job for the sheet T is temporarily suspended.

In the above embodiment, when the determination by the determining unit 613 that the raising time is an abnormal time has been performed continuously for a plurality of occasions, a warning by display on the display unit 473 is performed. However, an embodiment of this disclosure is realized also control up to a warning is not performed.

In FIG. 4A to FIG. 4E, an example is illustrated in which a sheet T on or after the sixth sheet stacked in the recording medium discharge tray 623 is stacked at the same position. However the disclosure is not limited thereby, and broad application is enabled in a configuration in which a plurality of height surfaces is formed on the upper surface of the sheets T stacked on the recording medium discharge tray 623.

The configuration and processing steps illustrated in the embodiments above using FIG. 1 to FIG. 4E are merely embodiments of the present disclosure, and the configuration and processing steps of the present disclosure are not limited thereby.

The invention claimed is:

1. A recording medium discharge device comprising:

a recording medium discharge unit configured to discharge a recording medium from a recording medium discharge port;

a stacking unit configured to stack the recording medium that is discharged from the recording medium discharge port by the recording medium discharge unit;

an ascending and descending unit configured to ascend and descend the stacking unit in a vertical direction relative to the recording medium discharge port;

an upper surface detecting unit configured to detect that the upper surface portion of the recording medium that is stacked in the stacking unit ascended and descended by the ascending and descending unit is positioned at a predetermined recording medium receiving position;

a discharge detecting unit configured to detect that the recording medium is discharged from the recording medium discharge port to the stacking unit;

a drive controlling unit configured to cause the ascending and descending unit to lower the stacking unit by a predetermined fixed amount when discharge of the recording medium to the stacking unit is detected by the discharge detecting unit, and to cause the ascending and descending unit to raise the stacking unit from the lowered position to which the stacking unit is lowered by the fixed amount to a position at which the upper surface of the recording medium stacked in the stacking unit is detected by the upper surface detecting unit;

a measuring unit configured to measure the raising time that is the time from the commencement to the completion of the raising operation of the stacking unit by the ascending and descending unit controlled by the drive controlling unit; and a determining unit configured to determine whether or not the raising time measured by the measuring unit is a predetermined abnormal time; wherein when the raising time is determined by the determining unit not to be the abnormal time, the drive controlling unit causes the recording medium discharge unit to execute a subsequent recording medium discharge to the stacking unit; and when the raising time is determined by the determining unit to be the abnormal time, the drive controlling unit causes the recording medium discharge unit to stop a subsequent recording medium discharge to the stacking unit, and the drive controlling unit then causes the ascending and descending unit to lower the stacking unit by an amount corresponding to the time difference between the raising time and a predetermined reference time, and causes the recording medium discharge unit to recommence the subsequent recording medium discharge.

2. The recording medium discharge device according to claim 1, further comprising a reporting unit configured to report to a user, and when the determining unit determined that the raising time is the abnormal time for a predetermined plurality of occasions, the drive controlling unit causes the reporting unit to report a warning to the user.

3. An image forming apparatus comprising:

the recording medium discharge device according to claim 1;

an image forming unit configured to execute image formation on a recording medium; and a reporting unit configured to report to a user; wherein when the drive controlling unit causes the recording medium discharge unit to stop a recording medium discharge operation, or causes the ascending and descending unit to stop an ascending and descending operation of the stacking unit, the drive controlling unit then causes the reporting unit to report a warning to the user.

* * * * *